US005776617A

United States Patent [19]

Brady et al.

[11] Patent Number: 5,776,617

[45] Date of Patent: Jul. 7, 1998

[54] OXIDATION-RESISTANT TI-AL-FE ALLOY DIFFUSION BARRIER COATINGS

[75] Inventors: Michael P. Brady, Cleveland; James L. Smialek, Strongsville; William J. Brindley, North Royalton, all of Ohio

[73] Assignee: The United States of America Government as represented by the Administrator of the National Aeronautics and Space Administration, Washington, D.C.

[21] Appl. No.: 735,368

[22] Filed: Oct. 21, 1996

[51] Int. Cl.[6] ..... B32B 15/00; B32B 15/01; C22C 21/00; C22C 14/00

[52] U.S. Cl. ..... 428/632; 428/652; 428/653; 428/654; 428/660; 428/678; 427/405; 420/551; 420/552; 420/418

[58] Field of Search ..... 428/544, 615, 428/650, 651, 652, 653, 654, 655, 660, 681, 682, 678, 632; 420/417, 418, 77, 81, 126, 528, 550, 551, 552; 148/421, 407; 427/405

[56] References Cited

U.S. PATENT DOCUMENTS

| | | | |
|---|---|---|---|
| 4,842,820 | 6/1989 | Huang et al. | 420/418 |
| 4,897,127 | 1/1990 | Huang | 148/133 |
| 4,916,028 | 4/1990 | Huang | 428/614 |
| 5,006,054 | 4/1991 | Nikkola | 420/552 |
| 5,028,491 | 7/1991 | Huang et al. | 420/418 |
| 5,067,988 | 11/1991 | Froes et al. | 148/20.3 |
| 5,077,140 | 12/1991 | Luthra et al. | 428/660 |
| 5,118,581 | 6/1992 | Shalaby | 428/433 |
| 5,149,497 | 9/1992 | McKee et al. | 428/614 |
| 5,304,344 | 4/1994 | Huang | 420/418 |
| 5,368,660 | 11/1994 | Durlu et al. | 148/421 |
| 5,413,871 | 5/1995 | Nelson et al. | 428/552 |
| 5,458,701 | 10/1995 | Kampe et al. | 148/421 |
| 5,525,779 | 6/1996 | Santella et al. | 219/137 WM |

OTHER PUBLICATIONS

Oxidation Mechanism of Gamma+LAVES Ti–Al–Cr Coating Alloys, Brady, Smialek, Humphrey and Smith, Oct. 1995, NASA Hi Temp Proceedings.

*Primary Examiner*—John J. Zimmerman
*Assistant Examiner*—Michael LaVilla
*Attorney, Agent, or Firm*—Kent N. Stone

[57] ABSTRACT

A diffusion barrier to help protect titanium aluminide alloys, including the coated alloys of the TiAlγ+$Ti_3Al$ ($\alpha_2$) class, from oxidative attack and interstitial embrittlement at temperatures up to at least 1000° C. is disclosed. The coating may comprise FeCrAlX alloys. The diffusion barrier comprises titanium, aluminum, and iron in the following approximate atomic percent:

Ti-(50–55)Al-(9–20)Fe.

This alloy is also suitable as an oxidative or structural coating for such substrates.

24 Claims, 3 Drawing Sheets

OXIDATION-RESISTANT TI-AL-FE ALLOY DIFFUSION BARRIER COATINGS

ORIGIN OF INVENTION

The invention described herein was made in part by employees of the United States Government and may be manufactured and used by the Government for governmental purposes without the payment of any royalties thereon or therefor.

FIELD OF INVENTION

This invention pertains to the art of alloys of titanium and aluminum, and more specifically to an oxidation coating and/or a diffusion barrier to limit the interaction between a titanium aluminide substrate and MCrAlX (e.g., FeCrAlY) coatings which protect the titanium aluminide from oxidation and interstitial embrittlement up to at least 1000° C. The diffusion barrier comprises a titanium-aluminum-iron alloy which is of intermediate Fe content, i.e., having an iron content between that of the FeCrAlY coating and the titanium aluminide substrate. Suitable Ti—Al—Fe alloys fall primarily in the γ-τ-Laves composition range. The Ti—Al—Fe diffusion barrier can be used to limit interaction between FeCrAlY coatings and titanium aluminide substrates, and further is itself suitable as an oxidation and embrittlement-resistant coating for titanium aluminides.

BACKGROUND OF THE INVENTION

Titanium aluminides are intermetallic compounds known to be candidate materials for use in advanced structural applications because they offer a desirable combination of low density and high temperature strength. In particular, substrates which are mixtures of TiAl (γ) and $Ti_3Al$ ($\alpha_2$) are being examined for high-temperature, structural applications including, for example, aircraft and automotive engines and exhaust systems. However, these materials are currently limited to applications below approximately 700°°C.–800° C. because of inadequate oxidation resistance. They are also susceptible to environmental embrittlement by interstitial diffusing species which may severely degrade their mechanical properties and limit their use as structural materials.

In the art, it is known that providing a metallic substrate with a coating may serve to enhance a substrate's structural properties. Such coatings are required to provide sufficient oxidative resistance without degrading the substrate's structural properties because of brittleness and chemical or thermal incompatibility.

MCrAlX-type coatings, where M is typically iron, nickel, or cobalt, and X is typically an active element such as Y, Zr, Hf, Yb, and similar reactive elements have been proposed to protect titanium aluminide substrates from oxidation and interstitial embrittlement. For example, FeCrAlY coatings have been shown to be effective in protecting titanium aluminides. However, the system has the disadvantage of diffusion over time between the titanium aluminide substrate and the FeCrAlY coatings which can lead to embrittled interlayers and coating failure. Consequently, these systems may require the use of a diffusion barrier to limit interaction between the coatings and the substrate. There have been diffusion barriers proposed for MCrAlX coatings on titanium aluminide substrates. For example, the use of tungsten as a diffusion barrier to limit the interaction between a FeCrAlY coating and a titanium aluminide substrate is discussed in a paper entitled "Oxidation and Protection of $Ti_3Al$-Based Intermetallic Alloys" (D. W. McKee, Mat. Res. Soc. Proc., Vol. 288, Materials Research Society, p. 953; 1993).

In general, the diffusion barriers known in the art have traditionally been nonoxidation-resistant materials such as tungsten. While diffusion barriers such as tungsten have successfully allowed coatings such as FeCrAlY to protect titanium aluminides from oxidation and interstitial embrittlement due to elevated temperature exposure in air, they are not practical because of poor oxidation resistance. Cracking of the outer FeCrAlY coating such as may occur during use due to mechanical or thermal loading would consequently result in rapid oxidation of the tungsten diffusion barrier; this would result in catastrophic failure of the coating. The titanium aluminum iron alloys of the present invention solve this problem since they are highly oxidation resistant.

SUMMARY OF THE INVENTION

In accordance with the present invention, alloys of Ti—Al—Fe are provided for use as an oxidation-resistant diffusion barrier between MCrAlX-type coatings and substrates such as titanium or titanium aluminide substrates, and further for use as coatings to protect titanium and titanium aluminide substrates from oxidation and interstitial embrittlement.

More particularly in accordance with the invention, an oxidation-resistant diffusion barrier is comprised primarily of Ti—Al—Fe Alloys of the $Ti(Fe,Al)_2$ Laves phase and the τ ($L1_2$) phase or the γ(TiAl) phase. This diffusion barrier is sufficiently oxidation-resistant that it can also be used without an MCrAlX overlayer coating to protect titanium and titanium aluminide alloys from oxidation and interstitial embrittlement.

In accordance with the invention, studies of oxidation behavior of titanium aluminides with significant quantities (5–30 atomic percent) of ternary alloying additions led to the identification of ternary Laves-type phases as a major source of excellent oxidation resistance. In particular, ternary Laves-type phases which are low in aluminum content have been found to exist in equilibrium with the γ (TiAl) and τ ($L1_2$) phases which are of much higher aluminum content. Additionally, the orientation of the phase fields is such that the γ or τ phases act as an aluminum reservoir for the Laves phase during oxidation. This is believed to contribute to the ability of the alloy to initiate and maintain a protective alumina-based scale, which provides the excellent oxidation resistance of the alloys. Thus, in accordance with the invention, alloys in the τ+ Laves and γ+ Laves Ti—Al—Fe composition range have been selected for use as oxidation-resistant coating(s), in particular for use as an oxidation-resistant diffusion barrier between FeCrAlY coatings and titanium aluminide and/or titanium substrates. The composition range is approximately Ti-(50–55)Al-(9–20)Fe atomic percent. The format of atomic percent used herein specifies the percent of aluminum and iron, the remainder from 100 being titanium. More particularly, compositions of Ti-53Al-11Fe and Ti-54Al-17Fe (atomic percent ±2 atomic percent each) have been found to exhibit protective alumina scale formation at 1000° C. in air. Thus according to one aspect of the present invention, an iron-modified titanium aluminum alloy consists essentially of iron, titanium, and aluminum, in the following approximate atomic percent:

Ti-(50–55)Al-(9–20)Fe.

These oxidation-resistant coatings can be used with an MCrAlX outer coating having superior mechanical properties. In this case, the titanium aluminum iron alloys act as a diffusion barrier. They are of "intermediate" iron content insofar as they have an iron content between that of a preferred FeCrAlY coating and a titanium aluminide substrate, i.e., 9–20 atomic percent. The diffusion barrier has the effect of limiting inward diffusion between the FeCrAlY coating and titanium aluminide substrates.

Particularly preferred alloys have phases in the τ+ Laves and/or in the γ+ Laves composition ranges. Because the Ti—Al—Fe alloys are titanium and aluminum based and of intermediate iron content between FeCrAlY coatings and titanium aluminide substrates, they can be used as a diffusion barrier to limit interaction between a FeCrAlY coating and titanium aluminide and titanium substrates.

The Ti—Al—Fe alloys of the present invention are also suitable as an oxidation-resistant diffusion barrier for other MCrAlX-type coatings, such as NiCrAlY and CoCrAlY, on titanium aluminide and titanium substrates. The Ti—Al—Fe alloys of the present invention are also suitable as an oxidation and interstitial embrittlement-resistant coating for titanium aluminide and titanium substrates. The Ti—Al—Fe alloys of the present invention also have uses as an oxidation-resistant structural material. The Ti—Al—Fe alloys of the present invention are also suitable for coating alumina-based fibers to prevent matrix-fiber interactions in titanium-based metal matrix composites.

In accordance with the invention, a particular use of the Ti—Al—Fe alloys is as a diffusion barrier between FeCrAlY oxidation-resistant coatings and $\gamma+\alpha_2$ titanium aluminide substrates, for example Ti-47Al-2Cr-4Ta and Ti-48Al-2Cr-2Nb. The advantage of this Ti—Al—Fe diffusion barrier is that it is oxidation resistant.

In another embodiment, the Ti—Al—Fe coatings of the invention can act as a diffusion barrier for MCrAlX-type coatings such as NiCrAlY or CoCrAlY.

In yet another embodiment, the Ti—Al—Fe coatings of the invention can be used with other possible titanium aluminide substrates: $\alpha_2$-based titanium aluminides, orthorhombic-based titanium aluminides, and α or β titanium aluminides and pure titanium.

Thus the titanium aluminum iron alloy of the present invention can be used as:

a) a diffusion barrier for MCrAlX-type coatings on titanium aluminides;

b) an oxidation and interstitial embrittlement-resistant coating for titanium aluminides;

c) an oxidation-resistant structural material; and d) a diffusion barrier between alumina-based fibers and titanium-based matrices in titanium metal matrix composites.

BRIEF DESCRIPTION OF THE DRAWINGS

The detailed description of the invention which follows will be understood with greater clarity if reference is made to the accompanying drawings in which.

DETAILED DESCRIPTION OF THE INVENTION

Studies of the oxidation behavior of titanium aluminides with significant quantities (5–30 atomic percent) of ternary alloying additions led to the identification of multiphase Ti—Al—Fe alloys, consisting primarily of a γ+ Laves or τ+ Laves microstructure, as holding the potential for excellent oxidation resistance. Air oxidation screenings were conducted and evaluated at 1000° C. in air for the Ti—Al—Fe alloys listed in Table I. The Ti—Al—Fe alloys were produced by arc-melting and casting techniques as are known in the art. Oxidation behavior was evaluated by visual inspection and/or cross-sectional analysis of the oxidized specimens using a scanning electron microscope equipped with energy-dispersive X-ray analysis.

The alloys Ti-53Al-11Fe (1) and Ti-54Al-17Fe (2) were found to exhibit excellent oxidation resistance due to the formation of an alumina-based oxide scale. Alumina-based scales are protective due to their very low rate of growth, and are also an effective barrier to the transport of interstitials such as oxygen and nitrogen into the alloy, which can result in embrittlement.

Figure 1:
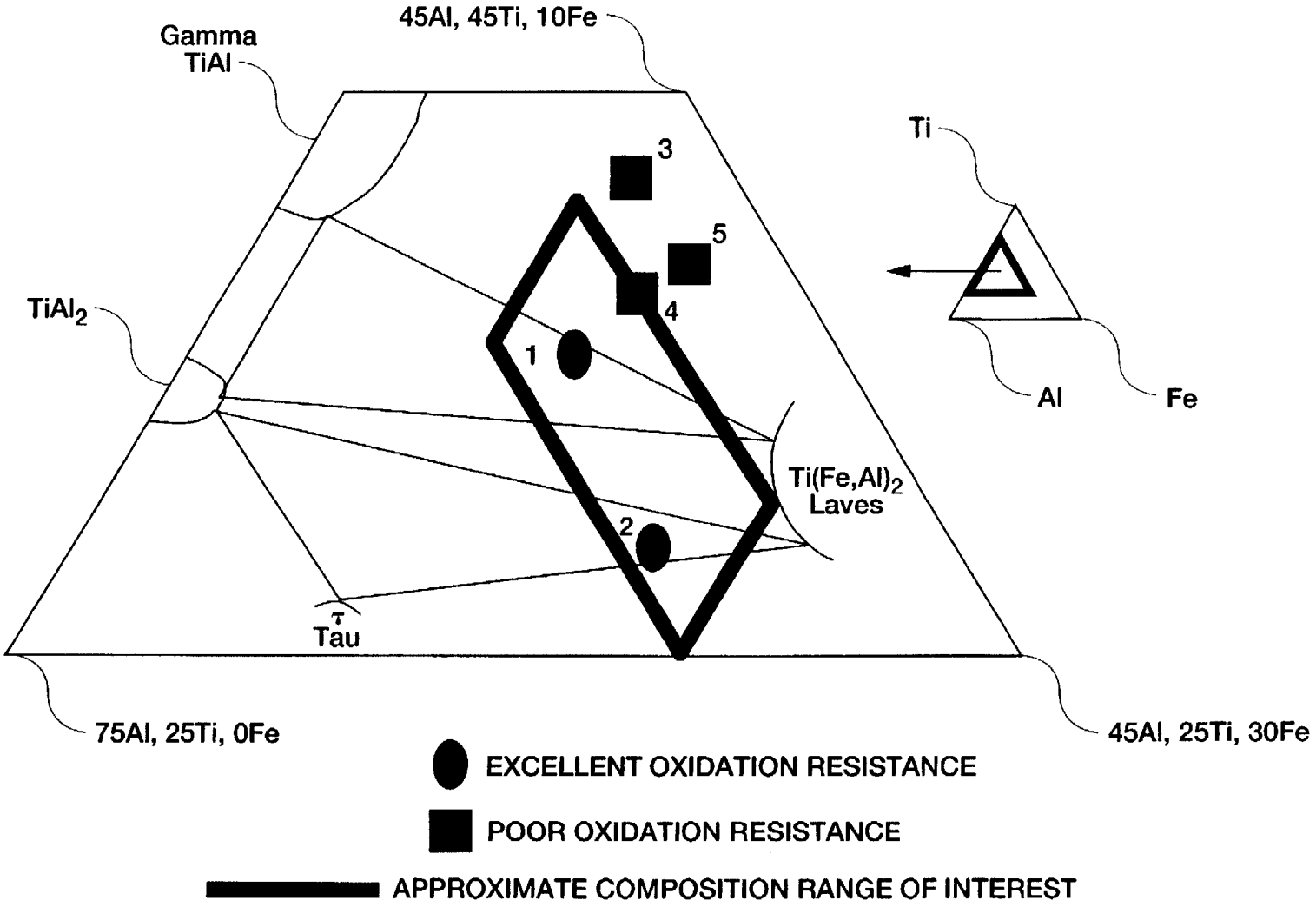
FIG. 1 is a phase diagram indicating the preferred composition range of Ti—Al—Fe alloys of the present invention.

The Ti—Al—Fe alloys of Table I are mapped on the schematic 1000° C. phase diagram (atomic percent) shown in FIG. 1. The alloys Ti-53-Al11Fe (1) and Ti-54Al-17Fe (2) exhibited excellent oxidation resistance. The microstructures of these alloys were examined in detail by electron microprobe and X-ray diffraction. The results of this analysis were used to create the partial schematic phase diagram shown in FIG. 1. Based on the composition range defined by the tie-lines of Ti-53Al-11Fe (1) and Ti-54Al-17Fe (2), and the relatively poor oxidation resistance of alloys 3–5 (Table I), the composition range of Ti-(50–55)Al-(9–20)Fe atomic percent was identified as oxidation-resistant (capable of alumina-based scale formation).

TABLE I

| ALLOYS (Atomic %) | 1000° C./100 Hour Air Oxidation Screening |
|---|---|
| Ti—53Al—11Fe (1) | Alumina Former (Excellent Oxidation Resistance) |
| Ti—54Al—17Fe (2) | Alumina Former (Excellent Oxidation Resistance) |
| Ti—48Al—10Fe (3) | Poor Oxidation Resistance |
| Ti—50Al—12Fe (4) | Poor Oxidation Resistance |
| Ti—48Al—13Fe (5) | Poor Oxidation Resistance |

Figure 2:
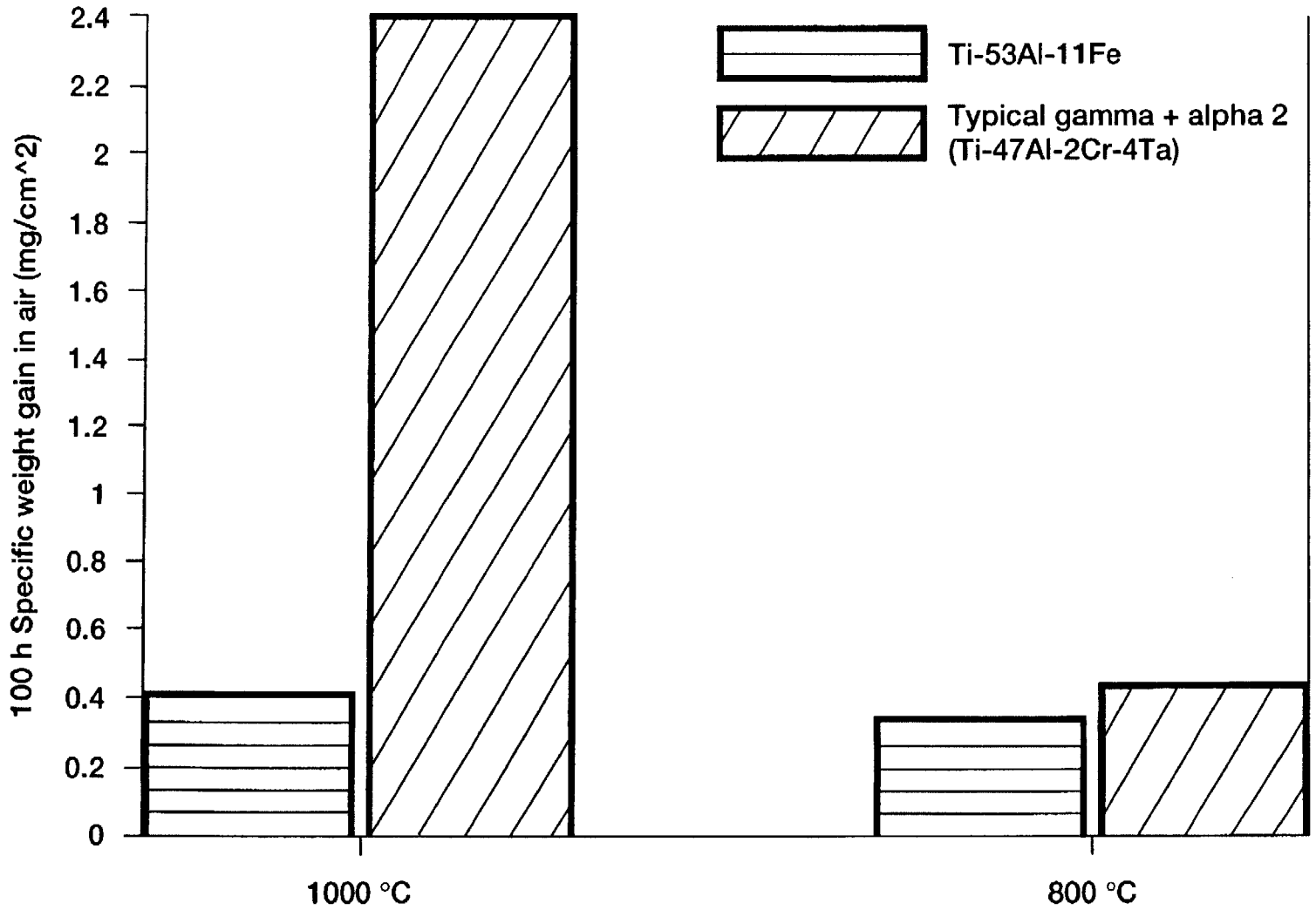
FIG. 2 is a bar graph showing oxidation weight gain for a typical Ti—Al—Fe alloy (Ti-53Al-11Fe) compared to a typical gamma+alpha 2 titanium aluminide alloy at both 800° C. and 1000° C.

Oxidation resistance data after 100 h at 1000° C. and 800° C. in air for Ti-53Al-11Fe and a typical $\gamma+\alpha_2$ alloy, Ti-47Al-2Cr-4Ta, is shown in FIG. 2. The Ti-53Al-11Fe alloy exhibits superior oxidation resistance to the $\gamma+\alpha_2$ alloy especially at 1000° C.

The Ti-(50–55)Al-(9–20)Fe atomic percent alloys of the present invention are ideal for use as a diffusion barrier to limit interaction between FeCrAlY coatings and titanium aluminide substrates. They are of intermediate Fe content between FeCrAlY coatings (which typically contain greater than 30–50 atomic percent Fe) and $\gamma+\alpha_2$ titanium substrates (which typically contain between 0–2 atomic percent Fe) and exhibit excellent oxidation resistance. In the event of cracking of the outer FeCrAlY layer, such as may occur during use due to mechanical or thermal loading, the Ti-(50–55)Al-(9–20)Fe atomic percent diffusion barrier would remain intact, while a nonoxidation-resistant diffusion barrier such as tungsten would be rapidly consumed by oxidation. Rapid oxidation of the diffusion barrier would lead to catastrophic failure of the FeCrAlY coating.

Figure 3:
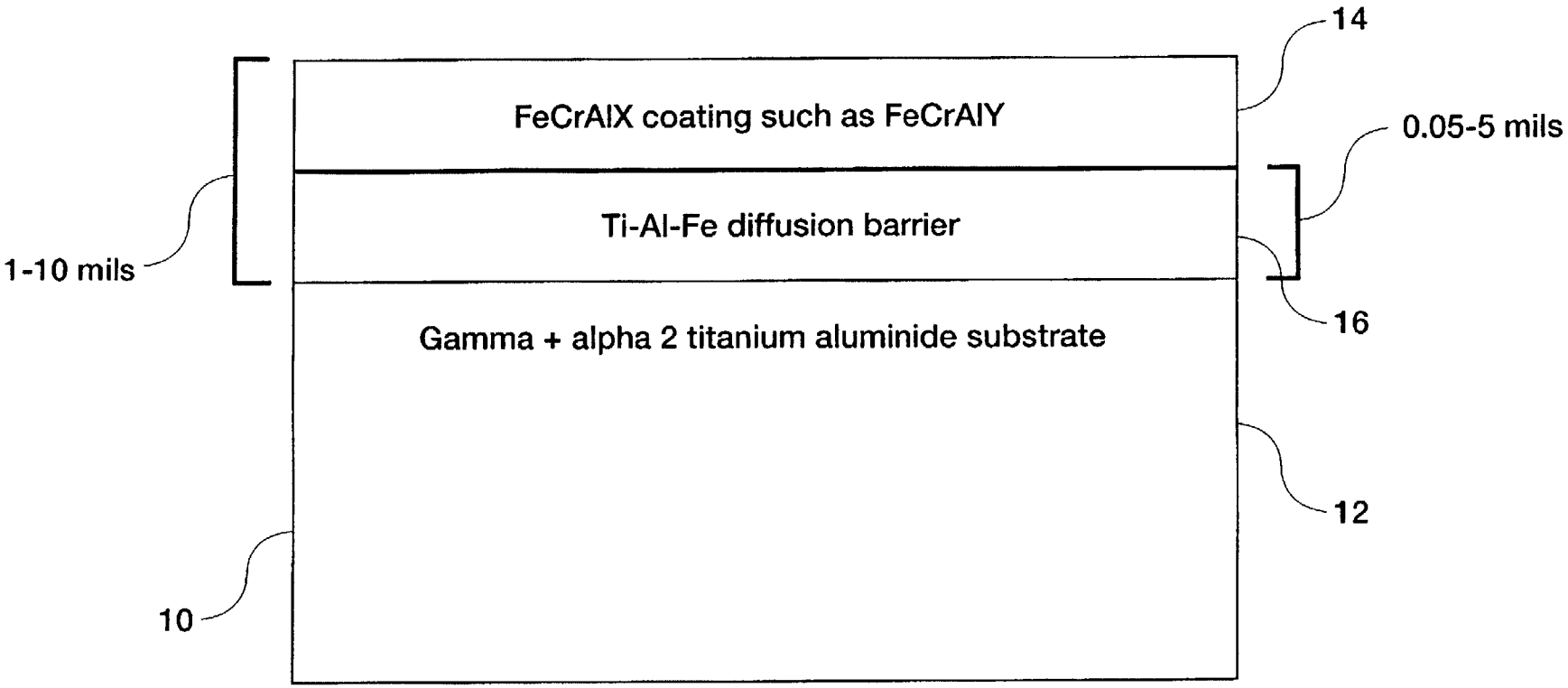
FIG. 3 is a schematic drawing of a Ti—Al—Fe diffusion barrier in accordance with the invention.

FIG. 3 shows a schematic drawing of a Ti—Al—Fe diffusion barrier for FeCrAlY coatings on $\gamma+\alpha_2$ titanium aluminide substrates. In this Figure, an article such as, for example, a turbine blade, is shown generally at 10. This article includes a $\gamma+\alpha_2$ titanium aluminide substrate 12 which is coated on at least one surface, and more preferably coated on all exposed surfaces with an oxidation protective coating 14 of about 1 to 10 mils total, comprising an outer layer of about 1 to about 9.95 (10) mils of FeCrAlY, and an intermediate layer of from about 0.05 to about 5 mils of a Ti—Al—Fe diffusion barrier 16. The coatings can be applied by coating techniques known in the art such as thermal spray, plasma spray, sputtering, physical vapor deposition, chemical vapor deposition, slurry processing, and other well known techniques.

In an alternate embodiment, the Ti—Al—Fe alloys of the present invention are also suitable oxidation-resistant coatings and/or for diffusion barriers for other titanium aluminide substrates such as $\alpha_2$-based or orthorhombic-based alloys such as Ti-24Al-11Nb or Ti-22Al-23Nb, respectively.

In still another use, the Ti—Al—Fe alloys are also suitable for coating alumina-based fibers to prevent matrix/fiber interactions in titanium-based metal matrix composites.

It will be apparent to those skilled in the art that the above methods may incorporate changes and modifications without departing from the general scope of this invention. It is intended to include all such modifications and alterations insofar as they come within the scope of the appended claims or the equivalents thereof.

Having thus described the invention, it is now claimed:

1. A ternary titanium aluminum iron alloy comprising titanium, aluminum, and iron in the following approximate atomic percent Ti-(50–55)Al-(9–20)Fe and including $Ti(Fe,Al)_2$ Laves phase.

2. A titanium aluminum iron alloy according to claim 1, wherein said alloy comprises one or more of Ti-53Al-11Fe and Ti-54Al-17Fe, compositions ±1 atomic percent.

3. A composite structural article comprising a substrate and a coating for protecting the substrate from oxidative attack and interstitial embrittlement at temperatures up to at least 1000° C., and a diffusion barrier between said substrate and said coating, the diffusion barrier comprising titanium, aluminum, and iron in the following approximate atomic percent:

Ti-(50–55)Al-(9–20)Fe.

4. The composite article of claim 3, wherein the substrate is a titanium aluminum-based alloy.

5. The composite article of claim 4, wherein the substrate alloy is selected from the group consisting of TiAl (gamma) titanium aluminide, $Ti_3Al$ ($\alpha_2$)-based titanium aluminide, orthorhombic-based ($Ti_2AlNb$) titanium aluminide, alumina-based fibers, and combinations of the above.

6. The composite article of claim 5, further comprising an exterior coating of MCrAlX, wherein M is iron, nickel, or cobalt, and X is optional and is yttrium, zirconium, hafnium, or ytterbium.

7. The composite article of claim 6, wherein said exterior coating comprises FeCrAlX.

8. An oxidation-resistant coating on a substrate, said coating comprising a multiphase alloy of titanium, aluminum, and iron in the following approximate atomic percent:

Ti-(50–55)Al-(9–20)Fe wherein a phase of said alloy comprises a Laves phase.

9. The coating of claim 8, wherein the substrate comprises titanium or a titanium aluminide alloy.

10. The coating of claim 9, wherein the titanium aluminide alloy comprises TiAl (gamma) titanium aluminide.

11. The coating of claim 9, wherein the titanium aluminide alloy comprises $Ti_3Al$ ($\alpha_2$) titanium aluminide.

12. The coating of claim 9, wherein the titanium aluminide alloy comprises a titanium aluminide comprising TiAl (gamma)+$Ti_3Al$ ($\alpha_2$).

13. The coating of claim 9, wherein the titanium aluminide alloy comprises orthorhombic-based titanium aluminide.

14. The coating of claim 9, wherein said coating alloy comprises one or more of Ti-53Al-11Fe and Ti-54Al-17Fe, compositions ±1 atomic percent.

15. The coating according to claim 9, wherein the substrate comprises an alumina-based fiber.

16. The coating according to claim 15, wherein said alumina-based fiber is in a titanium aluminide matrix composite.

17. The coating according to claim 16, wherein said coating alloy comprises one or more of Ti-53Al-11Fe and Ti-54Al-17Fe, compositions ±1 atomic percent.

18. The coating according to claim 9, further comprising an exterior coating of MCrAlX wherein M is iron, nickel, or cobalt, and X is optional and is yttrium, zirconium, hafnium, or ytterbium.

19. The coating according to claim 18, wherein the titanium aluminide alloy comprises TiAl (gamma) titanium aluminide.

20. The coating according to claim 19, wherein the titanium aluminide alloy comprises $Ti_3Al$ ($\alpha_2$) titanium aluminide.

21. The coating according to claim 19, wherein said substrate is an orthorhombic-based titanium aluminide.

22. A method of protecting titanium substrates comprising the step of applying a layer of alloy comprising Ti-(50–55) Al-(9–20)Fe atomic percent on said substrate, said alloy including $Ti(Fe, Al)_2$ Laves phase.

23. A method of protecting titanium substrates according to claim 22, further comprising the step of applying an outer coating of FeCrAlX on said layer, wherein X is yttrium, zirconium, hafnium, or ytterbium.

24. An oxidation-resistant coating on a substrate, said coating comprising the first layer of a multi-phase ternary alloy of titanium, aluminum, and iron in the following approximate atomic ratio:

Ti(50–55)-Al-(9–20)Fe and a second layer of MCrAlX on said layer wherein M is iron, nickel, or cobalt, and X is optional and is yttrium, zirconium, hafnium, or ytterbium.

* * * * *